United States Patent [19]

Liebe et al.

[11] Patent Number: 4,755,452

[45] Date of Patent: Jul. 5, 1988

[54] COLOR PHOTOGRAPHIC RECORDING MATERIAL AND A PROCESS FOR THE PRODUCTION OF PHOTOGRAPHIC IMAGES

[75] Inventors: Werner Liebe, Leverkusen; Hans Vetter, Cologne, both of Fed. Rep. of Germany

[73] Assignee: Agfa-Gevaert Aktiengesellschaft, Leverkusen-Bayerwerk, Fed. Rep. of Germany

[21] Appl. No.: 4,643

[22] Filed: Jan. 20, 1987

[30] Foreign Application Priority Data

Feb. 1, 1986 [DE] Fed. Rep. of Germany ..... 3603099

[51] Int. Cl.[4] ..... G03C 1/06; G03C 7/26; G03C 7/38

[52] U.S. Cl. ..... 430/372; 430/551; 430/554; 430/555; 430/558; 430/613

[58] Field of Search ..... 430/551, 372, 613, 558, 430/554, 555

[56] References Cited

U.S. PATENT DOCUMENTS

| | | | |
|---|---|---|---|
| 4,360,581 | 11/1982 | Odenwalder et al. | 430/559 |
| 4,420,554 | 12/1983 | Ohashi et al. | 430/613 |
| 4,614,702 | 9/1986 | Sawada et al. | 430/372 |
| 4,614,707 | 9/1986 | Fujita et al. | 430/551 |
| 4,675,275 | 6/1987 | Nishijima et al. | 430/551 |

*Primary Examiner*—Paul R. Michl
*Assistant Examiner*—Mark R. Buscher
*Attorney, Agent, or Firm*—Connolly and Hutz

[57] ABSTRACT

The stability to light of images produced from magenta couplers is improved by a combination of a hydroquinone and an indole.

12 Claims, No Drawings

COLOR PHOTOGRAPHIC RECORDING MATERIAL AND A PROCESS FOR THE PRODUCTION OF PHOTOGRAPHIC IMAGES

This invention relates to a colour photographic recording material containing at least one light-sensitive silver halide emulsion layer and at least one magenta coupler associated with this layer. The invention also relates to a process for the production of colour photographic images.

It is known to produce colour photographic images by chromogenic development, i.e. a process in which an imagewise exposed recording material containing at least one silver halide emulsion layer is developed by means of so-called colour developers in the presence of suitable colour couplers, and the oxidation product of developer substance produced in correspondence with the silver image reacts with the colour coupler to form a dye image. It is also known that image dyes produced by chromogenic development undergo changes to varying extents. One particularly troublesome change is the loss in colour density under the influence of light. It is known that magenta dyes produced from pyrazolone colour couplers undergo particularly severe bleaching under these conditions.

Although it is known that the stability of magenta dyes may be improved by the addition of various substances, as indicated in Nos. DE-A-1 547 684, DE-A-2 140 309, Nos. EP-A-69 068, EP-A-69 070, Nos. DE-A-2 952 511, DE-A-2 952 420, DE-A-2 420 066, DE-A-2 901 520, DE-A-2 748 553, DE-A-2 726 180, No. EP-A-137 271, Nos. DE-A-2 747 198, DE-A-3 100 298 and DE-A-2 526 468, which describe the addition of chromans, hydroquinones, metal complexes, phenols and indans, these substances do have disadvantages. Hydroquinones frequently flatten the gradation and give rise to coloured oxidation products in the course of storage. Indans are liable to increase the amount of yellowing while metal complexes may discolour the layer since most of them have a distinctive colour of their own.

If these substances are directly introduced into the layer containing the magenta coupler, the ratio of gelatine to other compounds in this layer may become very high with the result that additional gelatine must be added. The layers then become thicker and the images less sharp.

It is an object of the present invention to improve the stability to light of images obtained from magenta colour couplers, in particular of the pyrazolone series.

A colour photographic recording material containing at least one light-sensitive silver halide emulsion layer and at least one magenta colour coupler associated with this layer has now been found. According to the invention, at least one layer S which contains no magenta colour coupler contains at least one diffusion-resistant indole derivative and at least one diffusion resistant hydroquinone derivative. The layer S is preferably adjacent to a layer containing a magenta coupler. The green-sensitive layer is preferably separated from the blue-sensitive layer and the red-sensitive layer in each case by a layer S although the layer S could be arranged in any other position, e.g. between the layer support and the first light-sensitive silver halide emulsion layer or above the uppermost light-sensitive silver halide emulsion layer.

In a preferred embodiment, the indole derivative corresponds to the following formula I

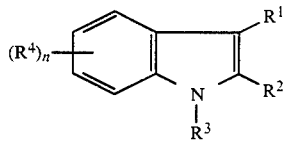

(I)

wherein $R^1$ denotes H, halogen, alkyl, aryl, amino, $NHSO_2X$, NH—COX, $NH—SO_2NR^5R^6$ or $NH—CONR^5R^6$.

X denotes an organic group, in particular a colourless group, $R^2$ denotes H, alkyl, aryl, $—COOR^5$ or

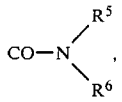

$R^3$ denotes H, alkyl, aryl, acyl, $SO_2$-alkyl or $SO_2$-aryl, $R^4$ denotes H, halogen, nitro, alkyl, alkoxy, $NH—SO_2$-alkyl, $NH—SO_2$-aryl, NH—CO-alkyl, NH—CO-aryl,

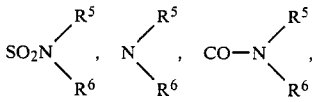

S-alkyl, S-aryl, $SO_3$-alkyl or $SO_2$-aryl, $R^5$ denotes H, alkyl or aryl, $R^6$ denotes H, alkyl or aryl, and n represents 0 or an integer from 1 to 4, under the condition that at least one of the groups $R^1$ to $R^6$ contains a diffusion resistance-conferring ballast group.

The following are particularly preferred groups $R^1$: H, $NH—SO_2$-alkyl, $NH—SO_2$-aryl, NH—CO-alkyl, NH—CO-aryl,

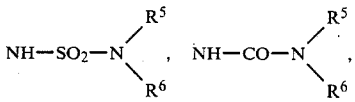

wherein $R^5$ and $R^6$ have the meanings indicated above.

In one particularly preferred embodiment, the various symbols in formula I have the following meanings:

$R^1$=hydrogen or $NH—SO_2—X$, $R^2$=alkyl with 1 to 5 carbon atoms, substituted or unsubstituted phenyl or CO—NH—X, X=an optionally substituted alkyl group preferably containing 1 to 20 carbon atoms, an optionally substituted aryl group, e.g. phenyl or naphthyl, or an optionally substituted heterocyclic group, preferably a 5- to 6-membered, nitrogen-containing heterocyclic group, $R^3$=H, $R^4$=H, halogen or a conventional ballast group and n=1.

In another preferred embodiment, the hydroquinone derivative corresponds to the following formula II

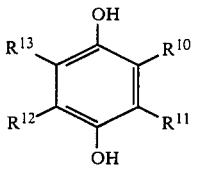

(II)

wherein $R^{10}$ and $R^{12}$, which may be identical or different, denote hydrogen, alkyl, in particular with 1 to 18 carbon atoms, $COR^{14}$, $R^{15}$—$COOR^{16}$ or $SO_3H$, $R^{11}$ denotes hydrogen, alkyl, in particular with 4 to 20 carbon atoms, or $R^{15}COOR^{16}$, $R^{13}$ denotes hydrogen or alkyl with 1 to 8 carbon atoms, $R^{14}$ denotes alkyl with 1 to 8 carbon atoms, $R^{15}$ denotes alkyl with 3 to 20 carbon atoms, $R^{16}$ denotes alkyl with 1 to 8 carbon atoms, cycloalkyl, in particular cyclopentyl or cyclohexyl, alkenyl, aryl or aralkyl with the proviso that the sum of carbon atoms in substituents $R^{10}$ to $R^{15}$ including any further substituents is in the range of 8 to 36.

In another preferred embodiment, the hydroquinone derivative corresponds to the following formula III

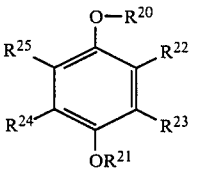

(III)

wherein $R^{20}$ denotes alkyl with 1 to 10 carbon atoms or CO—$R^{26}$, $R^{21}$ denotes H or $R^{20}$, $R^{22}$–$R^{25}$, which may be identical or different, denote hydrogen or alkyl with 1 to 20 carbon atoms, the sum of carbon atoms being preferably in the range of 8 to 40. One of the substituents is preferably hydrogen. When $R^{23}$ and $R^{25}$=H, $R^{22}$ and $R^{24}$ may also denote $R^{27}COOR^{28}$ in which $R^{27}$ denotes alkyl with 3 to 20 carbon atoms and $R^{28}$ denotes alkyl with 1 to 8 carbon atoms, cycloalkyl, alkenyl, aryl or aralkyl, and $R^{26}$ denotes alkyl with 1 to 4 carbon atoms.

In another preferred embodiment, the hydroquinone derivative corresponds to the following formula IV

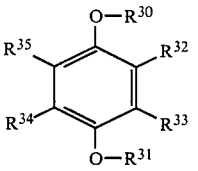

(IV)

wherein $R^{30}$ denotes $R^{36}$—$COOR^{37}$, $R^{31}$ denotes hydrogen or $R^{30}$, $R^{32}$–$R^{35}$, which may be identical or different, denote hydrogen or alkyl with 1 to 18 carbon atoms and the sum of carbon atoms is preferably in the range of 8 to 40, and one of the ligands is preferably hydrogen, $R^{36}$ denotes polymethylene with 3 to 20 carbon atoms and $R^{37}$ denotes (poly)methylene with 1 to 8 carbon atoms.

The substituents of the indole and hydroquinone derivatives may in turn be substituted with substituents commonly found in compounds of this kind used for photographic purposes.

The following formulae represent particularly preferred indole derivatives:

1.1

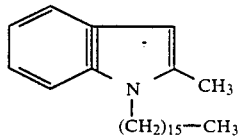

1.2

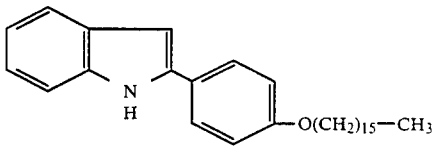

1.3

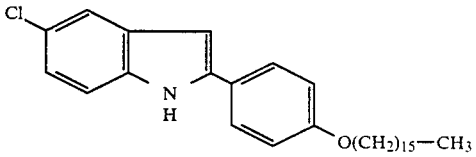

1.4

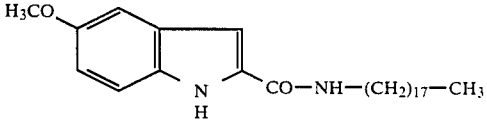

1.5

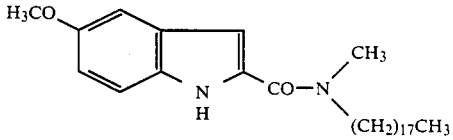

1.6

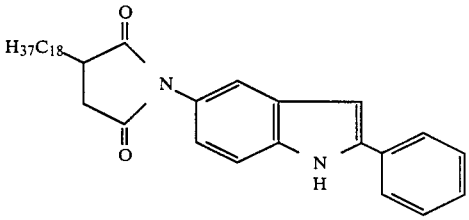

1.7

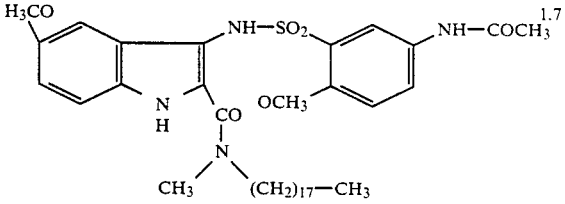

1.8

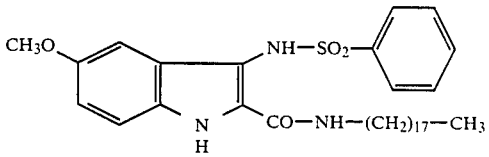

-continued
1.9
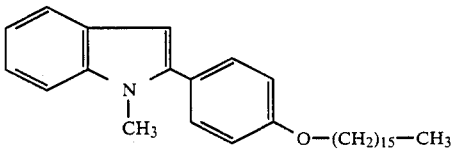
1.10
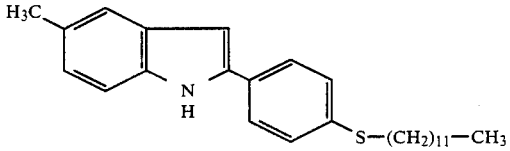
1.11
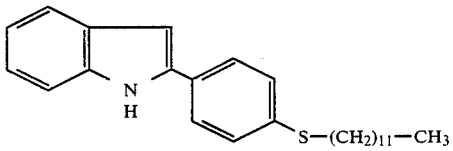
1.12
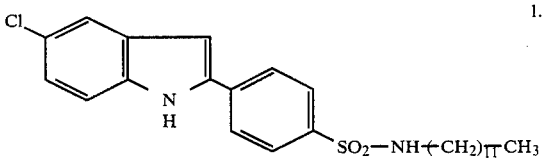
1.13
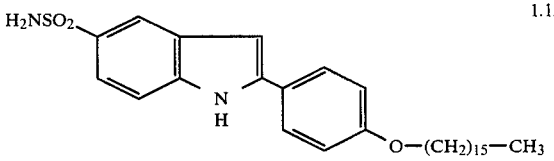
1.14
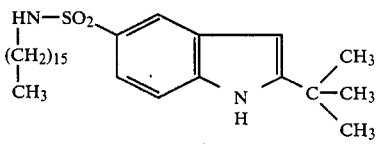
1.15
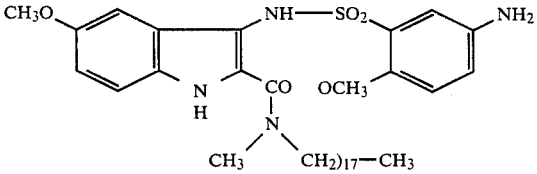
1.16
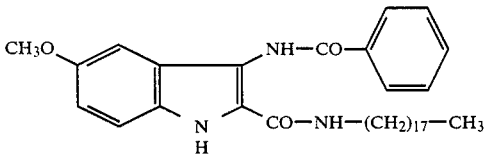
1.17
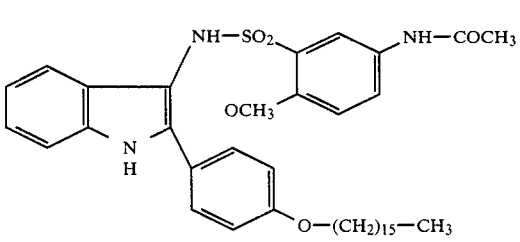
-continued
1.18
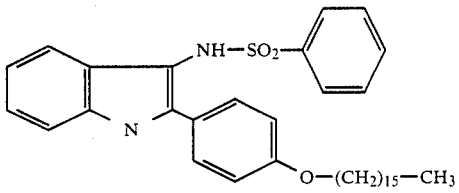
Other suitable indole compounds correspond to the following formula:
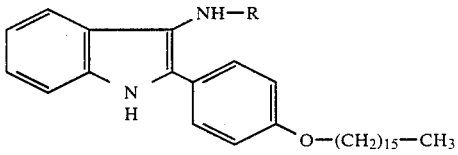
wherein R has the following meanings:
R = H 1.19
R = $SO_2CH_3$ 1.20
1.21
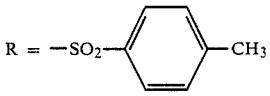
R = $SO_2N(CH_3)_2$ 1.22
1.23
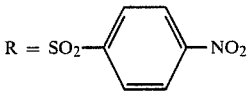
1.24
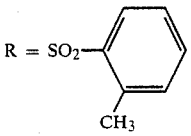
R = $-COCH_3$ 1.25
1.26
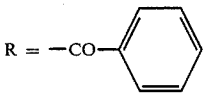
1.27
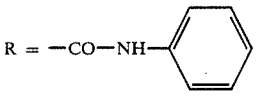
R = $-CONH_2$ 1.28
Other suitable indole compounds are indicated in Research Disclosure 19226 (April 1980) Nos. 1 to 15.
The following are suitable hydroquinone derivatives:

2.1

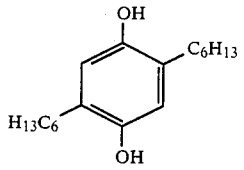

2.2

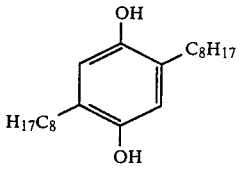

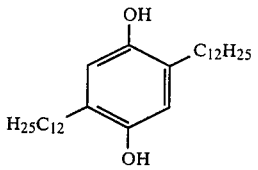

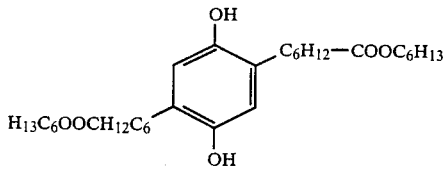

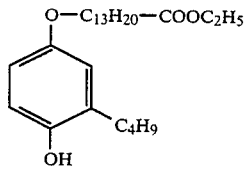

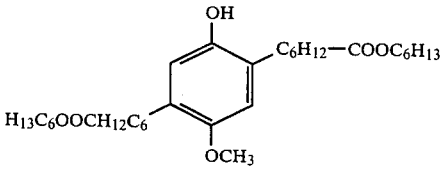

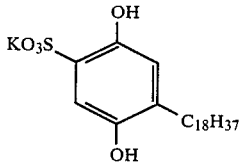

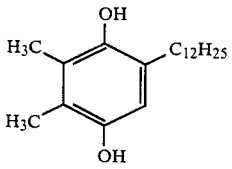

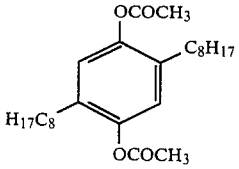

-continued 2.10

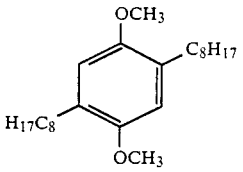

2.11

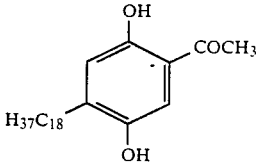

2.3 Methods of preparation of the dindole derivatives and hydroquinone derivatives are known; see, for example, No. DE-A-2,947,425, U.S. Pat. No. 4,360,581 is the U.S. counterpart of No. DE-A-29 47 425, J. Chem. Soc. (1965) pages 7185–7193 and Org. Synth. Volume 22, page 98.

2.4 The hydroquinone derivatives and the indole derivatives are preferably each used in quantities of 30 to 150 mg/m$^2$, in particular 50 to 100 mg/m$^2$. Since the compounds are difficultly soluble in water, they may be emulsifed with oil formers such as tricresyl phosphate in a known manner before they are added to the casting solution. The indole derivatives and the hydroquinone derivatives may be emulsified separately or together.

2.5 The indole derivatives and hydroquinone derivatives may optionally be emulsified together with other photographic compounds such as UV absorbents and added with them.

2.6 It is surprisingly found that the combination according to the invention improves the stability of the dyes obtained from magenta colour couplers without giving rise to any disadvantages. When indole derivatives are added to interlayers without hydroquinone derivatives, they produce hardly any effect. When the indole compounds are added to the silver halide emulsion containing the magenta couplers, they even give rise to a marked deterioration in the stability of the magenta dye to light and the white areas also undergo severe discolouration.

2.7 Hydroquinone compounds used on their own produce only a very slight improvement in the stability to light.

It was therefore surprising that the combined addition of an indole derivative and a hydroquinone derivative resulted in an excellent light stabilizing effect on the magenta dye without significantly impairing the white areas.

2.8 In a preferred embodiment, the colour photographic recording materials contain at least one silver halide emulsion layer unit for the recording of light from each of the three spectral regions red, green and blue.

2.9 Each of the aforesaid silver halide emulsion layer units may contain one or more silver halide emulsion layers. Colour photographic recording materials having double layers for the various spectral regions have been disclosed, for example, in U.S. Pat. Nos. 3,663,228, 3,849,138 and 4,184,876.

Colour photographic recording materials with triple layers are disclosed in Nos. DT-OS 2 018 341 and DE-3 413 800.

In a preferred embodiment, the photographic material contains one blue-sensitive, one green-sensitive and one red-sensitive silver haide emulsion layer, each with its associated colour couplers, arranged in that order on a layer support. In a particularly preferred embodiment, the green-sensitive layer is separated from the adjacent light-sensitive layers by at least one layer S to be used according to the invention. The layer S used according to the invention preferably does not contain any light-sensitive silver halide but this layer preferably contains at least one compound capable of absorbing UV light.

Formalin acceptors such as the iminopyrazolones disclosed in No. DE-A-3 148 108 and in U.S. Pat. No. 4,414,309 may in addition be contained in any layer.

In addition to the layers already mentioned, the colour photographic recording material according to the invention may contain other, light-insensitive auxiliary layers containing indole derivatives and hydroquinone derivatives, e.g. bonding layers, antihalation layers or covering layers and especially intermediate layers placed between the light-sensitive layers to prevent the diffusion of developer oxidation products from one layer to another. Such intermediate layers may also contain certain compounds capable of reacting with developer oxidation products to effectively prevent such diffusion, e.g. scavengers, DIR couplers or DAR couplers. Layers of this kind are preferably arranged between adjacenrt light-sensitive layers differing in their spectral sensitivity. Intermediate layers may also contain a low sensitivity silver halide emulsion having an average grain diameter of about 0.1 μm or less and containing chloride, bromide and optionally iodide. A layer of this kind has a particularly improving effect on the sensitivity of the adjacent layers although such a low sensitivity silver halide emulsion may also be introduced directly into the light-sensitive layers.

The light-sensitive silver halide emulsion layers preferably have associated with them colour couplers capable of reacting with colour developer oxidation products to form a dye. The colour couplers are preferably arranged directly adjacent to the silver halide emulsion layer or especially in the emulsion layer itself.

Thus the red-sensitive layer, for example, may contain a colour coupler to produce the cyan partial colour image, generally a coupler of the phenol or α-naphthol series. The green-sensitive layer may contain, for example, at least one colour coupler to produce the magenta partial colour image, normally a colour coupler of the 5-pyrazolone series. The blue-sensitive layer may contain, for example, at least one colour coupler to produce the yellow partial colour image, generally a colour coupler containing an open chain keto methylene group.

The colour couplers may be, for example, 6-, 4- or 2-equivalent couplers. Suitable couplers have been disclosed, for example, in the publications by W. Pelz entitled "Farbkuppler" in "Mitteilungen aus den Forschungslaboratorien der Agfa, Leverkusen/München", Volume III, page 111 (1961); by K. Venkataraman in "The Chemistry of Synthetic Dyes", Volume 4, 341 to 387, Academic Press (1971) and by T. H. James, in "The Theory of the Photographic Process", 4th Edition, pages 353–362, and they have also been disclosed in Research Disclosure No. 17643 of December 1878, Section VII, published by Industrial Opportunities Ltd., Homewell Havant, Hampshire, PO9 1 EF, Great Britain.

The usual masking couplers may be used to improve colour reproduction. In addition, the recording material may contain DIR compounds and white couplers which do not give rise to a dye when they react with colour developer oxidation products. The inhibitors released from the DIR compounds may be split off as such or by way of non-inhibitory intermediate compounds.

See in this connection GB No. 953 454, U.S. Pat. No. 3,632,345, U.S. Pat. No. 4,248,962 and GB No. 2 072 363 and Research Disclosure No. 10226 of October 1972.

The following Table contains examples of particularly suitable yellow couplers.

Y1

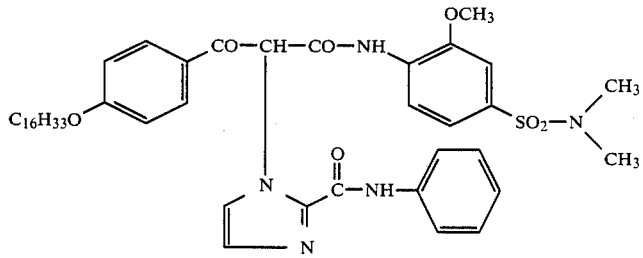

Y2

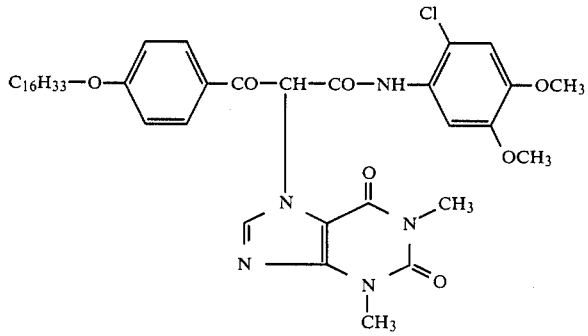

-continued
Y3
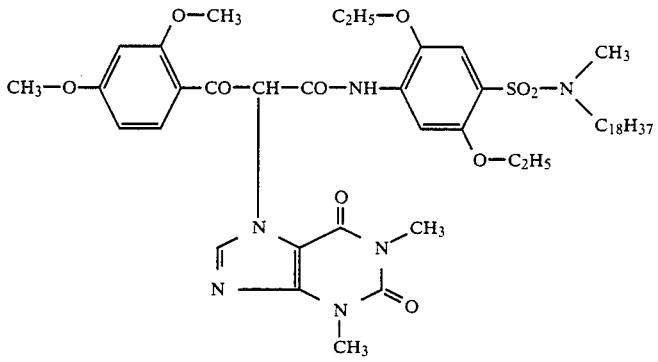
Y4
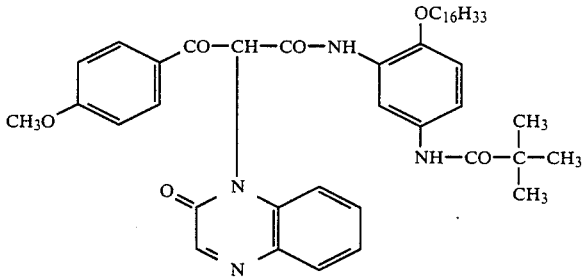
Y5
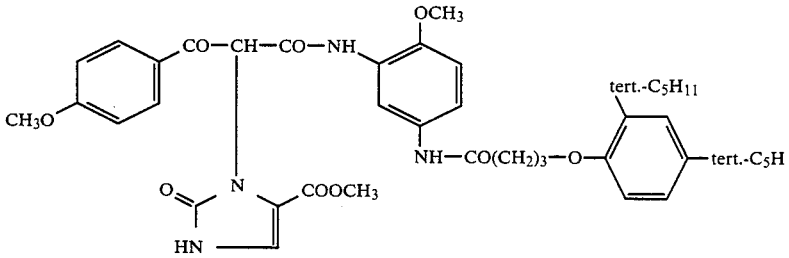
Y6
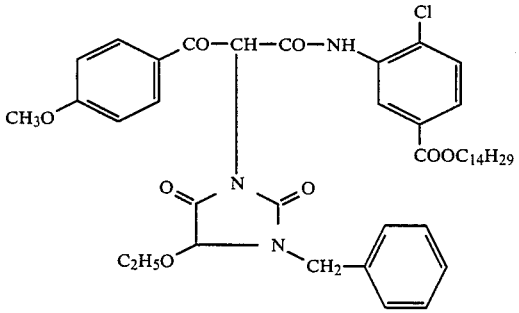
Y7
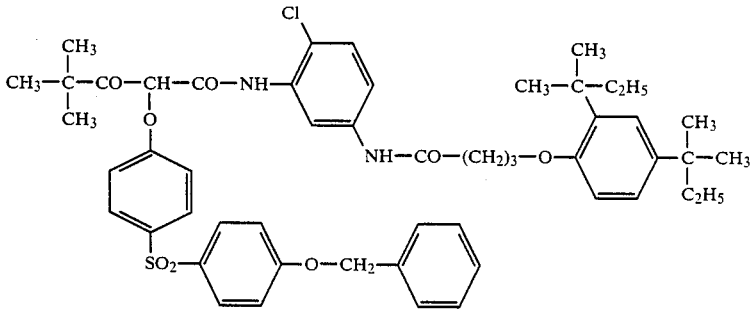

-continued
Y8
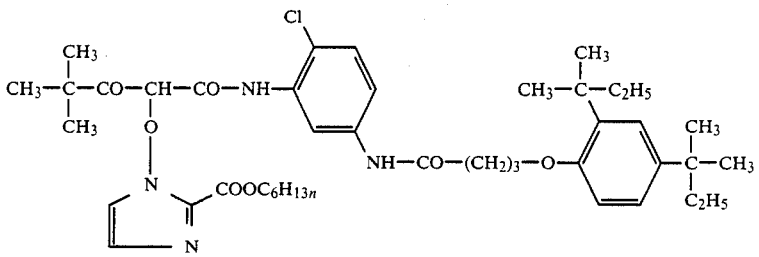
Y9
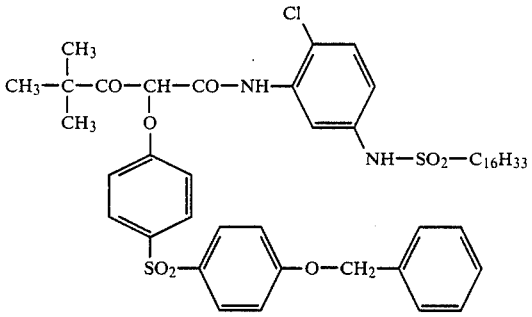
Y10
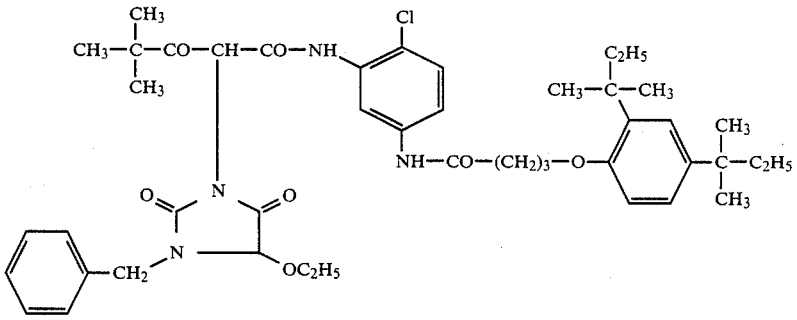
Y11
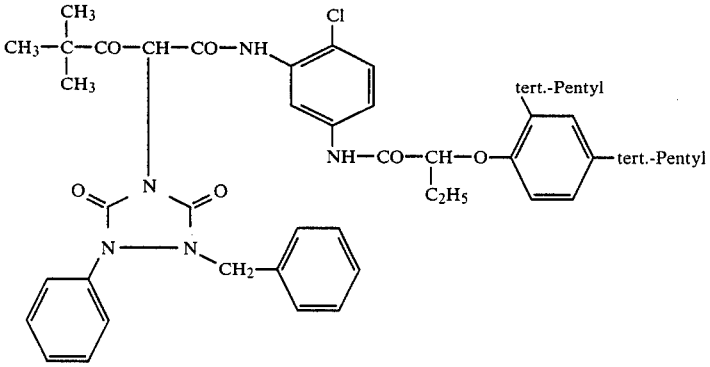
Y12
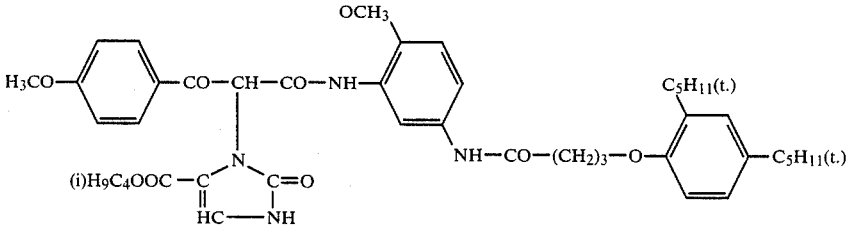

-continued
Y13
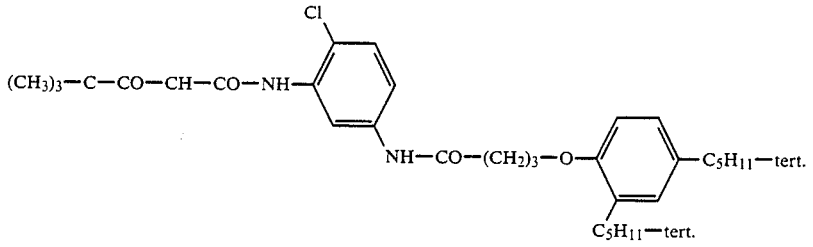
Y14
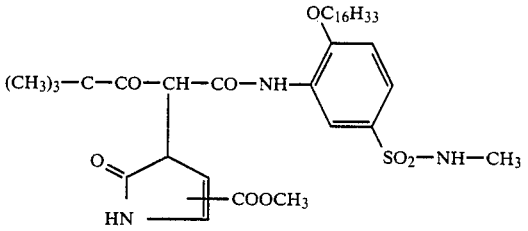
Examples of particularly suitable cyan couplers are given in the following Table:
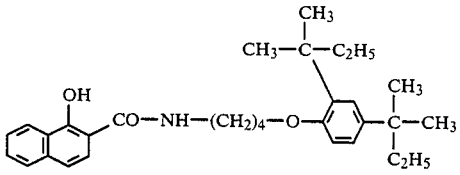
C1
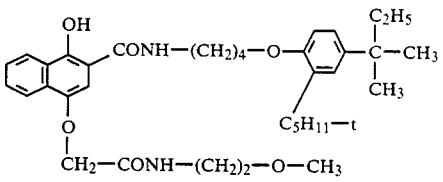
C2
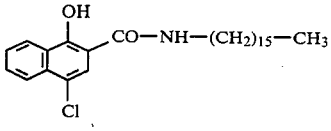
C3
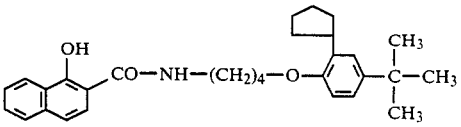
C4
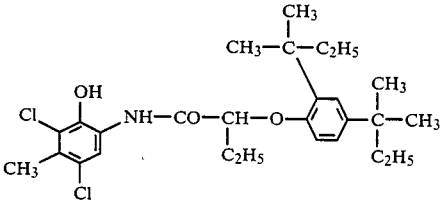
C5
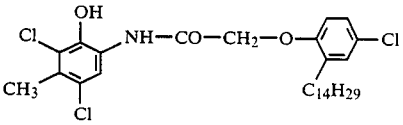
C6
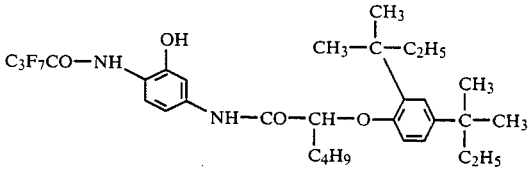
C7
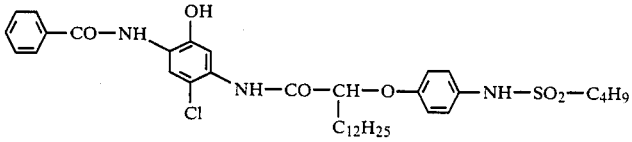
C8

-continued
C9
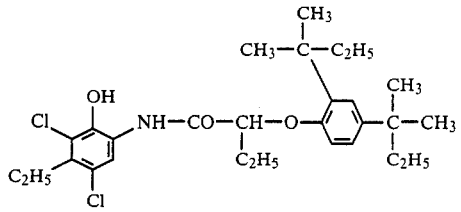
C10
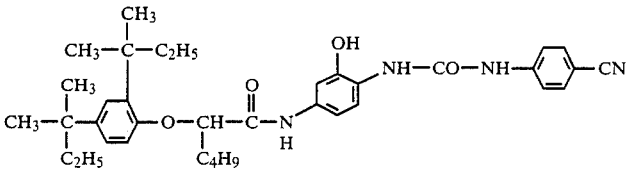
C11
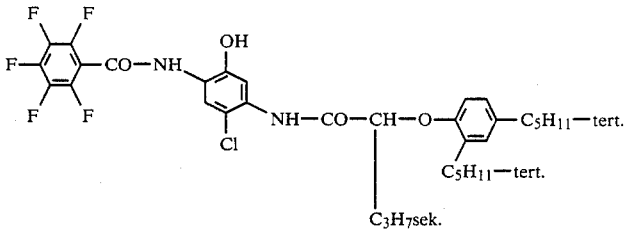
The following compounds may be used as magenta couplers:
Pp 1
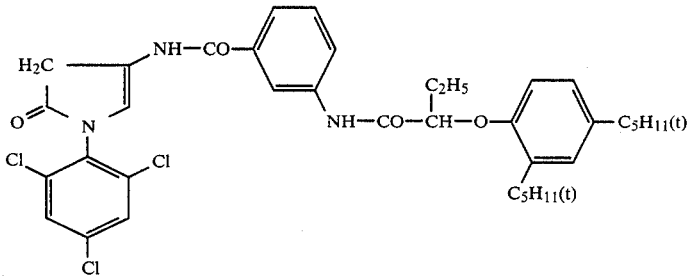
Pp 2
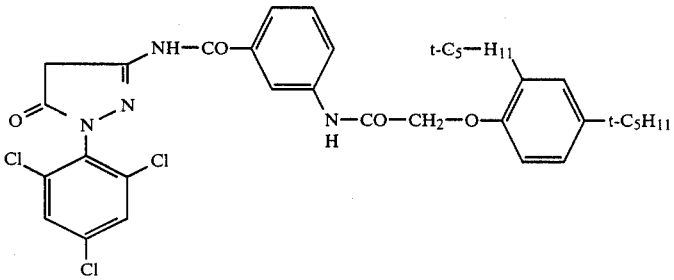
Pp 3
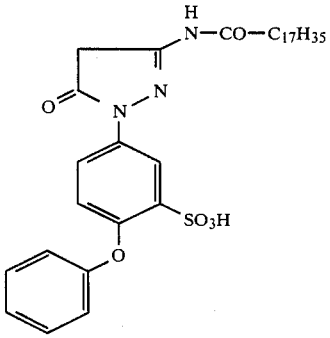
Pp 4
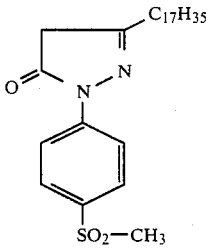

-continued
Pp 5
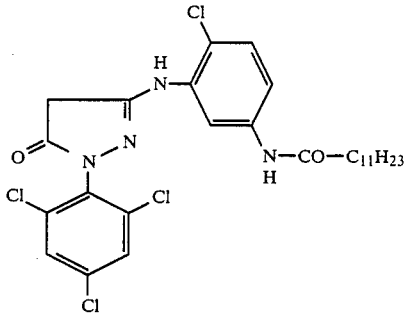
Pp 6
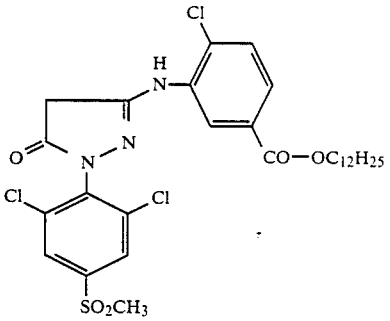
Pp 7
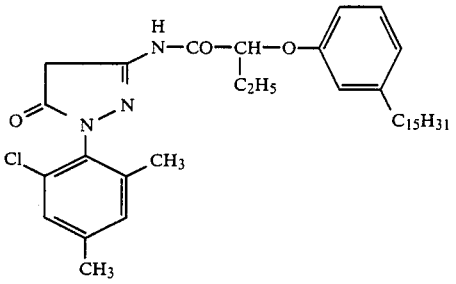
Pp 8
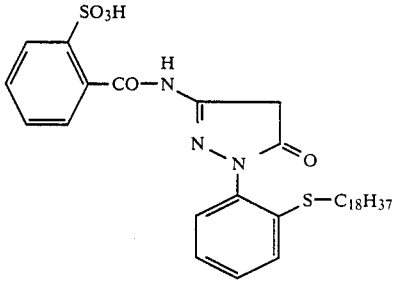
Pp 9
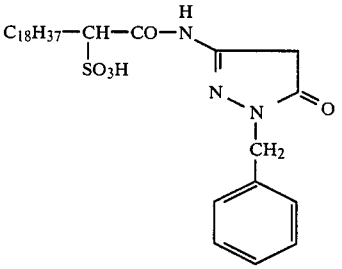
Pp 10
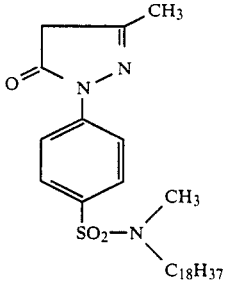
Pp 11
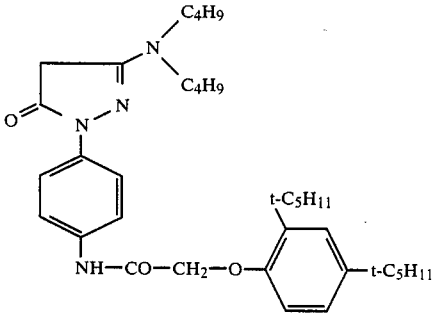
Pp 12
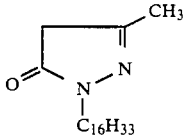
Pp 13
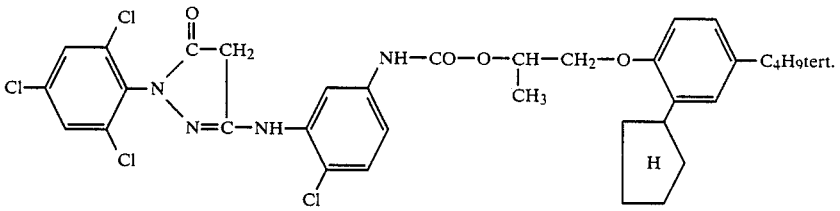
Pp 14
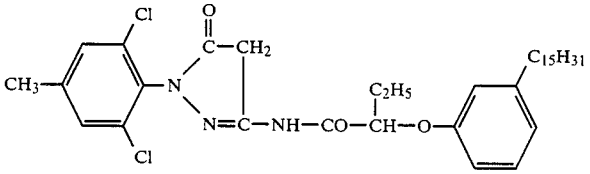

-continued
Pp 15
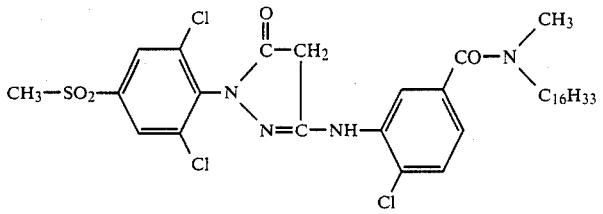
Pp 16
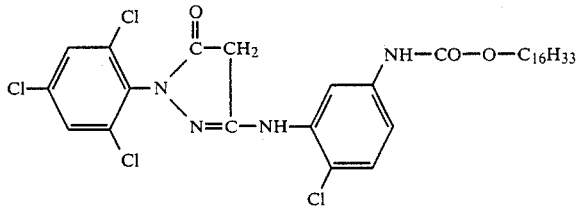
Pp 17
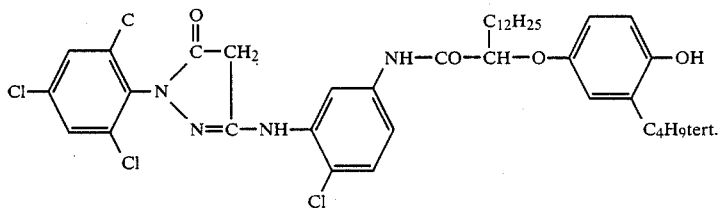
Pp 18
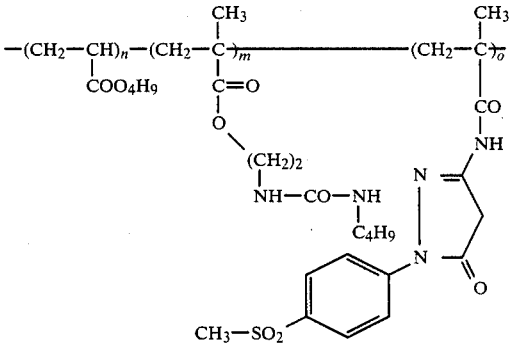
n = 30–70%
m = 10–20%
o = 20–50%
Pp 19
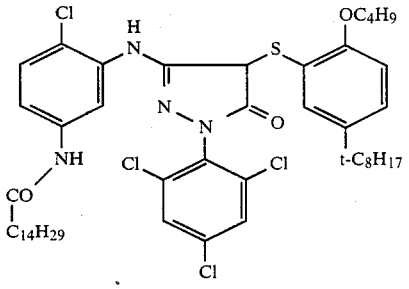
Pp 20
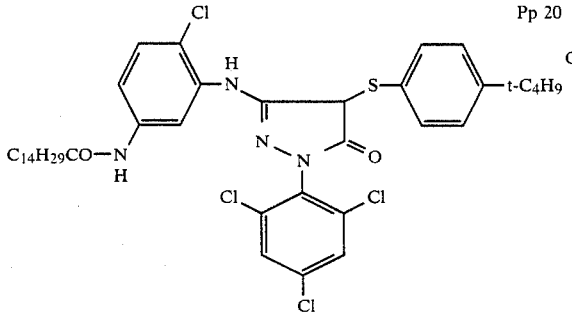
Pp 21
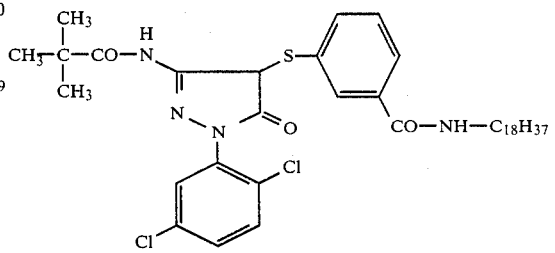

-continued
Pp 22
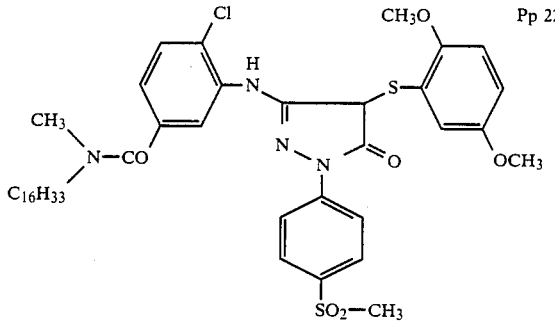
Pp 23
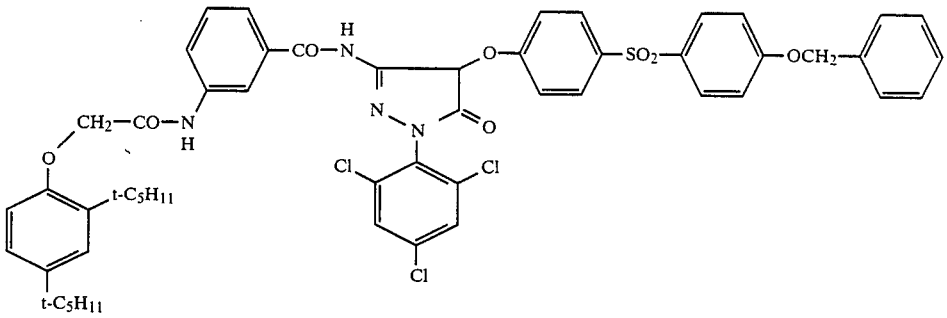
Pp 24
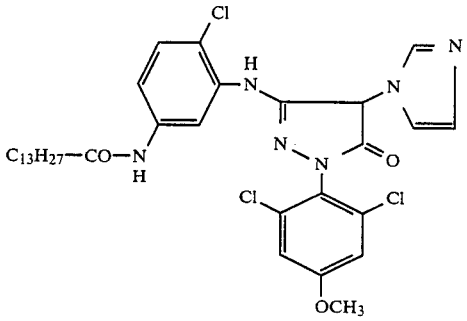
Pp 25
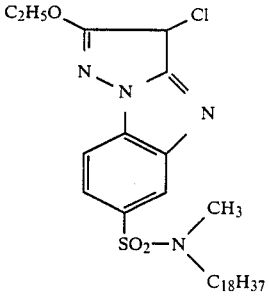
Pp 26
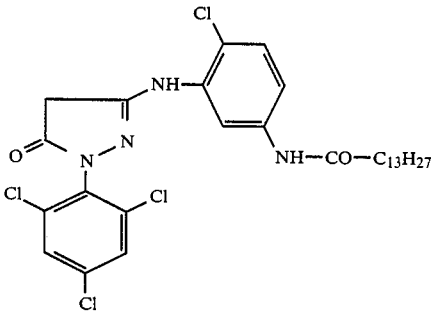
Pp 27
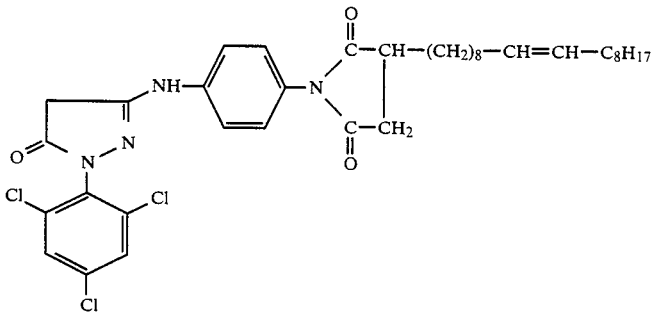

-continued
Pp 28
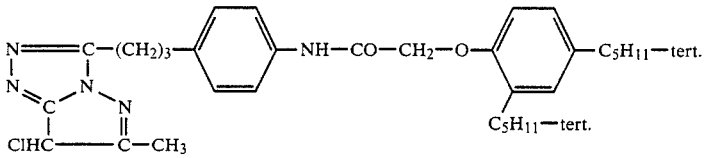
Pp 29
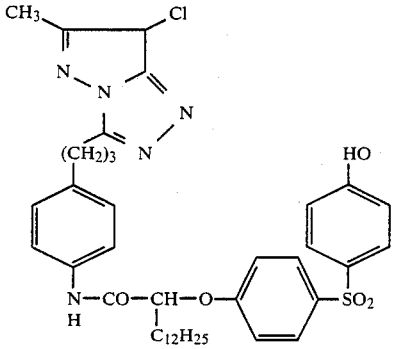
Suitable masking couplers are shown below:
-continued
M 1
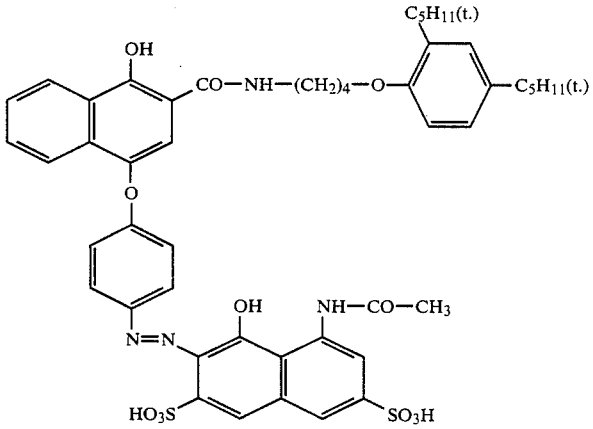
M 2
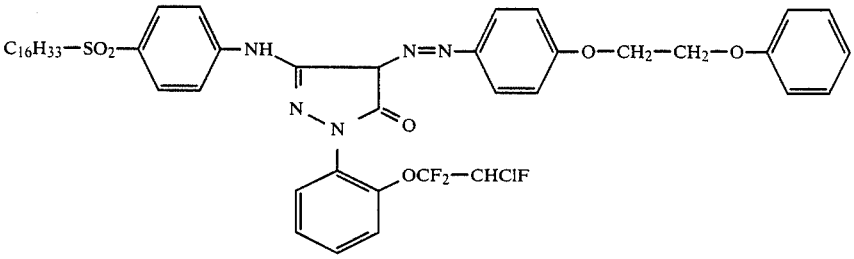
Suitable DIR Couplers have, for example, the following structure:
DIR 1
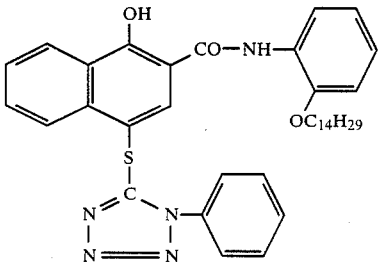

-continued

DIR 2

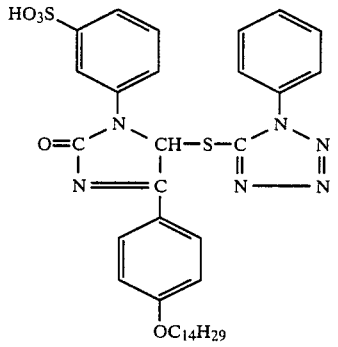

DIR 3

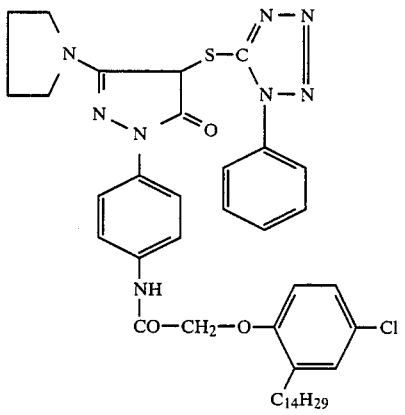

The halides present in the light-sensitive silver halide emulsions may be chloride, bromide, iodide or mixtures thereof. In a preferred embodiment, the halide content of at least one layer consists of 0 to 12 mol-% of AgI, 0 to 50 mol-% of AgCl and 50 to 100% of AgBr. In a preferred embodiment, the silver halide crystals are predominantly compact crystals, for example with cubic, octahedral or transitional forms. They may be characterised in that they predominantly have a thickness of more than 0.2 μm. The average ratio of diameter to thickness is preferably less than 8:1, the diameter of a grain being defined as the diameter of a circle having the same area as the projected surface of the grain. In another preferred embodiment, all the emulsions or some of the emulsions may contain mainly tabular silver halide crystals in which the ratio of diameter to thickness is greater than 8:1. The emulsions may be monodisperse emulsions preferably having an average grain size of from 0.3 μm to 1.2 μm and the silver halide grains may have a layered grain structure and a halide gradient.

The emulsions may be chemically sensitized. The usual sensitizing agents are suitable for chemical sensitization of the silver halide grains. Compounds containing sulphur are particularly preferred, e.g. allyl isothiocyanate, allylthiourea and thiosulphates. Noble metals such as gold, platinum, palladium, iridium, ruthenium or rhodium and compounds of these metals are also suitable chemical sensitizers. This method of chemical sensitzation has been described in the article by R. Koslowsky, Z. Wiss. Phot. 46, 65–72 (1951). The emulsions may also be sensitized with polyalkylene oxide derivatives. See also the above mentioned Research Disclosure No. 17643, Section III.

In a preferred embodiment, the silver halide emulsions used for the materials according to the invention are negatively functioning silver halide emulsions, i.e. the image obtained from them after conventional exposure and colour negative processing is a negative image, in contrast to that obtained from direct positive, fogged or unfogged emulsions.

The emulsions may be optically sensitized in a known manner, e.g. with the usual polymethine dyes such as neutrocyanines, basic or acid carbocyanines, rhodacyanines, hemicyanines, styryl dyes, oxonoles and the like. Sensitizers of this kind are described by F. M. Hamer in "The Cyanine Dyes and related Compounds", (1964). See also in particular Ullmanns Enzyklopädie der technischen Chemie, 4th Edition, Volume 18, pages 431 et seq, and the above mentioned Research Disclosure No. 17643, Section IV.

The usual antifoggants and stabilizers may be used. Azaindenes are particularly suitable stabilizers, especially the tetra- and penta-azaindenes and particularly those which are substituted with hydroxyl groups or amino groups. Compounds of this kind have been described, e.g. in the article by Birr, Z. Wiss. Phot. 47, 1952, pages 2–58. Other suitable stabilizers and antifoggants are mentioned in the aforesaid Research Disclosure No. 17643, Section IV. Suitable compounds for improving the resistance to formalin are mentioned in U.S. Pat. No. 4,464,463.

The recording material may also contain stabilizers for protecting the developed image, such as stabilizers against the action of visible light, UV absorbents which protect against shortwave radiation, and compounds for improving the stability in storage. The substances are added to the multilayered constructions as emulsions or in polymeric form. They may also be added directly as solutions in the oil phase of the couplers when the colour components are being emulsified.

The following are examples of compounds suitable for use as stabilizers against light and UV light and for improving the storage stability.

ST 1

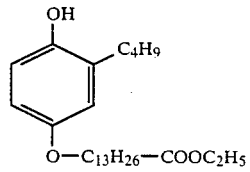

ST 2

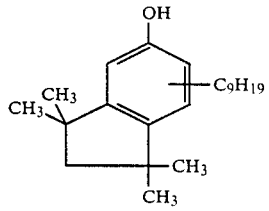

ST 3

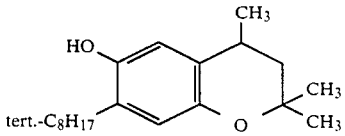

-continued

ST 4

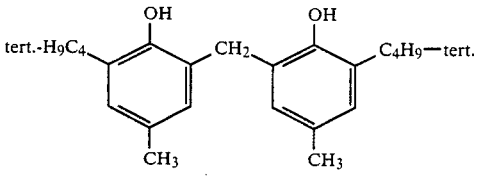

ST 5

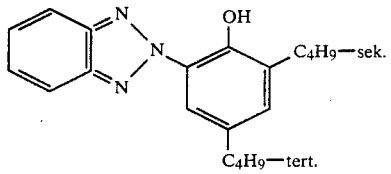

ST 6

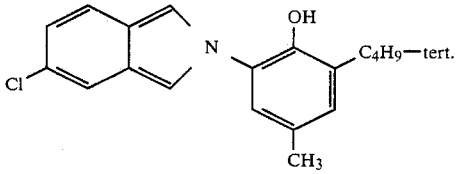

ST 7

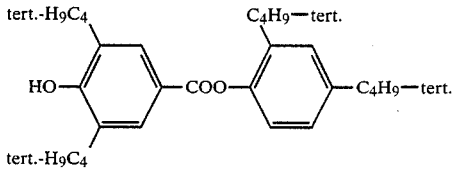

The components of the photographic material may be incorporated by the usual, known methods. If the compounds to be incorporated are soluble in water or alkalies, they may be added in the form of aqueous solutions, optionally with the addition of water-miscible organic solvents such as ethanol, acetone or dimethylformamide. If they are insoluble both in water and in alkalies, they may be added to the recording materials as dispersions in a known manner. For example, a solution of these compounds in a low boiling organic solvent may be added directly to the silver halide emulsion or it may first be mixed with an aqueous gelatine solution and the resulting dispersion of the required compound may then be mixed with the silver halide emulsion after removal of the organic solvent. So-called oil formers may be used in addition. These are generally relatively high boiling organic compounds in which the compounds to be dispersed are enclosed in the form of oily droplets.

See in this connection, for example, U.S. Pat. Nos. 2,322,027, 2,533,514, 3,689,271, 3,764,336 and 3,765,897. It is also possible, for example, to incorporate couplers in the form of charged latices, see DE-OS No. 2 541 274 and EP-A No. 14 921. The components may also be fixed in the material as polymers, see e.g. DE-OS No. 2 044 992, U.S. Pat. No. 3,370,952 and U.S. Pat. No. 4,080,211.

The usual layer supports may be used for the materials according to the invention, see Research Disclosure No. 17643, Section XVII.

The usual hydrophilic film-forming agents, e.g. proteins, especially gelatine, may be used as protective colloids or binders for the layers of the recording material. Casting auxiliaries and plasticizers may also be used. See in this connection the compounds mentioned in the above Research Disclosure 17643, Sections IX, XI and XII.

The layers of photographic material may be hardened in the usual manner, for example with hardeners of the epoxide type or of the type of heterocyclic ethylene imine or acryloyl. The process according to German Offenlegungsschrift No. 2 218 009 may also be employed for hardening the layers in order to produce colour photographic materials which are suitable for high temperature processing. Hardeners of the diazine, triazine or 1,2-dihydroquinoline series or vinyl sulphone type hardeners may also be used for the photographic layers. Other suitable hardeners are disclosed in German Offenlegungsschriften Nos. 2 439 551, 2 225 230 and 2 317 672 and the abovementioned Research Disclosure 17643, Section XI.

The following formulae represent examples of known hardeners:

H 1

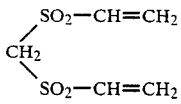

H 2

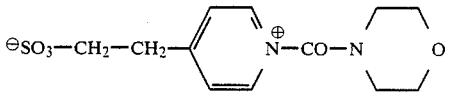

Other suitable additives are indicated in Research Disclosure 17643 and in "Product Licensing Index" of December 1971, pages 107–110.

The invention also relates to a process for the production of colour photographic images by imagewise exposure and colour development of the material according to the invention.

Suitable colour developer substances for the material according to the invention include in particular those of the p-phenylenediamine type, e.g. 4-amino-N,N-diethylaniline hydrochloride; 4-amino-3-methyl-N-ethyl-N-β-(methanesulphonamido)-ethyl aniline sulphate hydrate; 4-amino-3-methyl-N-ethyl-N-β-hydroxyethylaniline sulphate; 4-amino-N-ethyl-N-(2-methoxyethyl)-m-toluidine-di-p-toluene sulphonic acid and N-ethyl-N-β-hydroxyethyl-p-phenylene diamine. Other suitable colour developers are described, for example, in J. Amer. Chem. Soc. 73, 3100 (1951) and in G. Haist, Modern Photographic Processing, 1979, John Wiley and Sons, New York, pages 545 et seq.

The material is bleached and fixed in the usual manner after colour development. Bleaching and fixing may be carried out together or separately. The usual bleaching agents may be used, e.g. $Fe^{3+}$ salts and $Fe^{3+}$ complex salts such as ferricyanides, dichromates, water-soluble cobalt complexes, etc. Iron-III complexes of aminopolycarboxylic acids are especially preferred, in particular of e.g. ethylene diaminotetracetic acid, nitrilotriacetic acid, iminodiacetic acid, N-hydroxyethylethylenediaminotriacetic acid and of alkyliminodicarboxylic acids and of corresponding phosphonic acids. Persulphates are also suitable bleaching agents.

The following Examples, which describe preferred embodiments of the invention, serve to illustrate the invention. Percentages given denote percentages by weight unless otherwise indicated.

EXAMPLE 1

A combination of layers was prepared by applying the layers described below in succession to a layer support in the form of a polyethylene paper carrying a substrate layer. The quantities given refer in each case to 1 $m^2$. The quantities of silver applied are given in terms of the corresponding quantities of $AgNO_3$.

(a) A blue sensitized silver chlorobromide emulsion (10 g $AgNO_3$/100 g) to which the yellow coupler of the formula Y 8 was added. The yellow coupler was emulsified with 50% tricresyl phosphate in a 5% gelatine solution before being added. The ratio of yellow coupler to gelatine was 1:0.75. The ratio of silver to coupler was 1:1.20 and the amount of silver applied corresponded to 0.55 g of $AgNO_3/m^2$.

(b) A gelatine protective layer containing 1.2 g of gelatine.

(c) A green-sensitized silver chlorobromide emulsion (10 g silver nitrate/100 g) containing 0.44 g of magenta coupler of the formula Pp 26. The magenta coupler was emulsified with 50% dibutylphthalate in a 5% gelatine solution before being added (ratio of coupler to gelatine is 1:0.75). A light stabilizer of formula ST 1 was in addition added to the coupler-containing phase in a quantity of 50%, based on the coupler.

The ratio of silver to coupler was 1:0.8. The hydroquinone derivative of formula 2.2 was also added to the layer in a quantity of 7% by weight, based on the coupler. The hydroquinone compound was introduced as a gelatine emulsion with 100% tolyl phosphate, The quantity of silver application in the layer was 0.55 g.

(d) A UV protective layer 1 g of UV absorbent ST 6 and 9 g of UV absorbent ST 5 were emulsified with 10 g of tricresyl phosphate in a 5% gelatine solution in the usual manner.

The ratio of UV absorbent to gelatine was 1:1. The total amount of the two UV absorbents applied was 0.75 g/$m^2$.

(e) A red-sensitized silver chlorobromide emulsion (10 g $AgNO_3$/100 g) to which a cyan coupler of formula C 9 was added. The coupler was emulsified with 50% dibutylphthalate in a 5% gelatine solution (ratio of coupler to gelatine = 1:0.75). The ratio of silver to coupler was 1:1. Silver application: 0.4 g.

(f) A gelatine protective layer containing 1.5 g of gelatine/$m^2$.

The resulting combination of layers was then hardened to such an extent with a 1% solution of hardener that the amount of water absorbed by the combination in the course of the development process described below was 26 to 34 g/$m^2$. Compound H 1 was used as the hardener.

The combination of layers obtained after this hardening was then varied by additions according to the invention to the protective layers (b) and (d) as shown in the Table below.

The resulting materials were then exposed imagewise behind blue, green and red filters and processed as follows:

| Colour development process | Temperature (°C.) | Time |
|---|---|---|
| 1. Colour development | 33 | 3 min 30 s |
| 2. Bleach fixing | 33 | 1 min 30 s |
| 3. Washing with water | 26 | 2 min |
| 4. Drying | | |

The various baths had the following compositions:

COLOUR DEVELOPMENT SOLUTION

| | |
|---|---|
| Benzyl alcohol | 15 ml |
| Potassium carbonate | 30 g |
| Potassium bromide | 0.5 g |
| Hydroxylamine sulphate | 2 g |
| Sodium sulphate | 2 g |
| Diethylene triamine | 1 g |
| N—Ethyl-N—β-methanesulphonamidoethyl-3-methyl-4-aminoaniline sulphate | 4.5 g |
| made up with water to | 1 l |

BLEACH/FIXING SOLUTION

| | |
|---|---|
| Ammonium thiosulphate (70%) | 150 ml |
| Sodium sulphite | 5 g |
| Na[Fe (EDTA)] | 40 g |
| EDTA | 4 g |
| made up with water to | 1 l |

The samples obtained were measured and then exposed to $15 \times 10^6$ Lux hours in daylight in accordance with DIN standard 54003 to determine the amount of bleaching. The percentage loss in density was then determined for the original densities D = 1.1 and D = 0.7. The results are shown in the following Table.

TABLE

| | Layer d | | | | Layer b | | | | Percentage Loss in density at D = 0.7 | | | Percentage Loss in density at D = 1.1 | | |
|---|---|---|---|---|---|---|---|---|---|---|---|---|---|---|
| | Hydroquinone | | Indole | | Hydroquinone | | Indole | | | | | | | |
| Experiment | Compound | Quantity | Compound | Quantity | Compound | Quantity | Compound | Quantity | Blue- | Green-Exposure | Red- | Blue- | Green-Exposure | Red- |
| A, Comparison | — | — | — | — | — | — | — | — | −16 | −38 | −19 | −14 | −24 | −17 |
| B, Comparison | 2.2 | 80 | — | — | — | — | — | — | −16 | −37 | −20 | −14 | −24 | −17 |
| C, Invention | 2.2 | 80 | 1.17 | 80 | — | — | — | — | −14 | −25 | −19 | −12 | −18 | −16 |
| D, Comparison | — | — | 1.17 | 80 | — | — | — | — | −15 | −34 | −21 | −13 | −23 | −16 |
| E, Invention | 2.2 | 80 | 1.18 | 70 | — | — | — | — | −14 | −24 | −20 | −12 | −17 | −16 |
| F, Invention | 2.2 | 80 | 1.17 | 40 | — | — | — | — | −14 | −30 | −20 | −13 | −20 | −15 |

TABLE-continued

| Experiment | Layer d Hydroquinone Compound | Layer d Hydroquinone Quantity | Layer d Indole Compound | Layer d Indole Quantity | Layer b Hydroquinone Compound | Layer b Hydroquinone Quantity | Layer b Indole Compound | Layer b Indole Quantity | Percentage Loss in density at D = 0.7 Blue-Exposure | Green-Exposure | Red- | Percentage Loss in density at D = 1.1 Blue-Exposure | Green-Exposure | Red- |
|---|---|---|---|---|---|---|---|---|---|---|---|---|---|---|
| G, Invention | 2.2 | 80 | 1.17 | " | 2.2 | 80 | 1.17 | 50 | −13 | −22 | −19 | −12 | −16 | −16 |
| H, Invention | 2.2<br>2.5 | 80<br>100 | 1.18 | 70 | — | — | — | — | −13 | −21 | −20 | −12 | −15 | −17 |
| J, Invention | 2.2 | 80 | 1.1 | 70 | — | — | — | — | −14 | −25 | −20 | −12 | −18 | −16 |

The quantities are the amounts in $mg/m^2$

The experimental results given in the Table clearly show that the combination according to the invention of the indole compounds with hydroquinone compounds results in a marked improvement in the stability to light not only of the magenta dye but also of the yellow dye in the photographic material.

Neither of the two substances produces any significant improvement in the stability to light of yellow and magenta when used on its own.

We claim:

1. Colour photographic recording material containing at least one light-sensitive silver halide emulsion layer and at least one magenta colour coupler associated with this layer, characterised in that at least one diffusion-resistant indole derivative and at least one diffusion-resistant hydroquinone derivative are contained in at least one layer S which contains no magenta colour coupler.

2. Colour photographic recording material according to claim 1, characterised in that the indole derivative corresponds to the following formula I

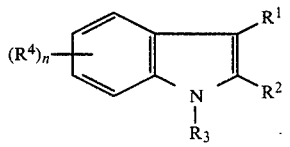

(I)

wherein $R^1$ denotes H, halogen, alkyl, aryl, amino, $NHSO_2X$, NH—COX, NH—$SO_2NR^5R^6$ or $NHCONR^5R^6$, in which X denotes an organic group;

$R^2$ denotes H, alkyl, aryl, $COOR^5$ or

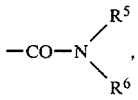

$R^3$ denotes H, alkyl, aryl, acyl, $SO_2$-alkyl or $SO_2$-aryl, $R^4$ denotes H, halogen, nitro, alkyl, alkoxy, NH—$SO_2$-alkyl, NH—$SO_2$-aryl, NH—CO-alkyl, NH—CO-aryl,

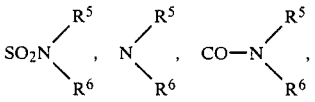

S-alkyl, S-aryl, $SO_2$-alkyl or $SO_2$-aryl, $R^5$ denotes H, alkyl or aryl, $R^6$ denotes H, alkyl or aryl, n denotes 0 or an integer from 1 to 4, with the proviso that at least one of the groups $R^1$ to $R^6$ contains a diffusion-resistance conferring ballast group.

3. Colour photographic recording material according to claim 2, characterised in that $R^1$ denotes hydrogen or NH—$SO_2$—X, $R^2$ denotes alkyl with 1 to 5 carbon atoms, substituted or unsubstituted phenyl or CO—NH—X, $R^3$ denotes hydrogen, $R^4$ denotes hydrogen, halogen, alkoxy or a ballast group, and X denotes a colourless residue.

4. Colour photographic recording material according to claim 1, characterised in that the hydroquinone derivative corresponds to the following formula II

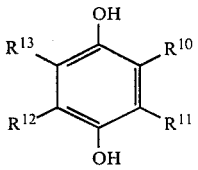

(II)

wherein $R^{10}$ and $R^{12}$ may be identical or different and denote hydrogen, alkyl, in particular with 1 to 18 carbon atoms, $COR^{14}$, $R^{15}$—$COOR^{16}$ or $SO_3H$, $R^{11}$ denotes hydrogen, alkyl, in particular with 4 to 20 carbon atoms, or $R^{15}COOR^{16}$, $R^{13}$ denotes hydrogen or alkyl with 1 to 8 carbon atoms, $R^{14}$ denotes alkyl with 1 to 8 carbon atoms, $R^{15}$ denotes alkyl with 3 to 20 carbon atoms, and $R^{16}$ denotes alkyl with 1 to 8 carbon atoms, cycloalkyl, in particular cyclopentyl or cyclohexyl, alkenyl, aryl or aralkyl, with the proviso that the sum of carbon atoms in the substituents $R^{10}$ to $R^{15}$, including further substituents, is from 8 to 36.

5. Colour photographic recording material according to claim 1, characterised in that the hydroquinone derivative corresponds to the following formula III

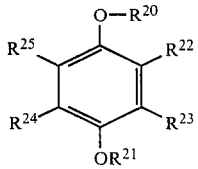

(III)

wherein $R^{20}$ denotes alkyl with 1–10 carbon atoms or $CO—R^{26}$, $R^{21}$ denotes H or $R^{20}$, $R^{22}$–$R^{25}$ may be identical or different and denote hydrogen or alkyl with 1 to 20 carbon atoms, and $R^{26}$ denotes alkyl with 1 to 4 carbon atoms.

6. Colour photographic recording material according to claim 1, characterised in that the hydroquinone derivative corresponds to the following formula IV

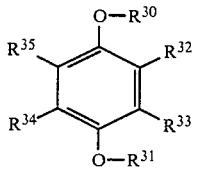

(IV)

wherein $R^{30}$ denotes $R^{36}—COOR^{37}$, $R^{31}$ denotes hydrogen or $R^{30}$, $R^{32}$–$R^{35}$ may be identical or different and denote hydrogen or alkyl with 1 to 18 carbon atoms, $R^{36}$ denotes polymethylene with 3 to 20 carbon atoms, and $R^{37}$ denotes (poly)methylene with 1 to 8 carbon atoms.

7. Colour photographic recording material according to at least one of the preceding claims, characterised in that the recording material contains, mounted on a layer support in the given sequence, at least one blue-sensitive, one green-sensitive and one red-sensitive silver halide emulsion layer with associated colour couplers.

8. Colour photographic recording material according to claim 7, characterised in that the green-sensitive layer is separated from the blue-sensitive and the red-sensitive layer by, in each case, a layer S.

9. Colour photographic recording material according to claim 1 characterised in that the layer S contains no light-sensitive silver halide.

10. Colour photographic recording material according to claim 1, characterised in that layer S in addition contains a UV absorbent compound.

11. Colour photographic recording material according to claim 1, characterised in that the layer S is arranged adjacent to a layer containing a magenta colour coupler.

12. Process for the production of colour photographic images by imagewise exposure and colour development of a recording material, characterised in that a recording material according to claim 1 is used.

* * * * *